US008879360B2

(12) United States Patent
Barzegar

(10) Patent No.: US 8,879,360 B2
(45) Date of Patent: Nov. 4, 2014

(54) ACOUSTIC LENS

(71) Applicant: Kongsberg Maritime AS, Horten (NO)

(72) Inventor: Abdolghaffar Barzegar, Port Coquitlam (CA)

(73) Assignee: Kongsberg Maritime AS, Horten (NO)

( * ) Notice: Subject to any disclaimer, the term of this patent is extended or adjusted under 35 U.S.C. 154(b) by 9 days.

(21) Appl. No.: 13/759,403

(22) Filed: Feb. 5, 2013

(65) Prior Publication Data

US 2013/0208570 A1 Aug. 15, 2013

(30) Foreign Application Priority Data

Feb. 15, 2012 (NO) ..... 2012 0153

(51) Int. Cl.
*G10K 11/30* (2006.01)

(52) U.S. Cl.
CPC ..... *G10K 11/30* (2013.01); *G10K 2200/11* (2013.01)
USPC ..... 367/150

(58) Field of Classification Search
CPC ..... G10K 11/30; G10K 2200/11
USPC ..... 367/150
See application file for complete search history.

(56) References Cited

U.S. PATENT DOCUMENTS

| | | | | |
|---|---|---|---|---|
| 3,776,361 | A | 12/1973 | Rolle | |
| 3,990,035 | A | 11/1976 | Byers | |
| 4,168,482 | A | 9/1979 | Sternberg | |
| 6,377,514 | B1 | 4/2002 | Linnenbrink et al. | |
| 8,203,909 | B1 | 6/2012 | Hickling | |
| 2009/0122639 | A1 * | 5/2009 | Hall et al. | 367/7 |
| 2013/0208570 | A1 * | 8/2013 | Barzegar | 367/150 |

FOREIGN PATENT DOCUMENTS

| | | | |
|---|---|---|---|
| EP | 2018551 | A2 * | 1/2009 |
| GB | 1432632 | A | 4/1976 |
| GB | 2500091 | A * | 9/2013 |
| WO | WO-2007/125500 | A3 | 11/2007 |

* cited by examiner

*Primary Examiner* — Daniel Pihulic
(74) *Attorney, Agent, or Firm* — Winstead PC

(57) ABSTRACT

A subsea sonar unit includes an acoustic transducer. The acoustic transducer transmitting an acoustic beam defining an acoustic propagation path for acoustic signals to or from the transducer, and the unit also includes a housing at least a part of which being oil filled and positioned in the propagation path of the beam. The housing is acoustically transparent in the direction of the acoustical beam and has an outer surface with a known shape in the propagation path. The unit also includes a corrective lens, the corrective lens being mounted in the propagation path between the transducer and the housing part the interface between which defining a first surface having a shape relative to the cross section of the acoustic beam in the propagation path essentially corresponding to the shape of the housing surface relative to the beams cross section at the housing surface in the propagation path.

12 Claims, 3 Drawing Sheets

ACOUSTIC LENS

BACKGROUND OF THE INVENTION

1. Technical Field

This invention relates to a subsea sonar unit comprising an acoustic transducer embedded in a protective oil where the acoustic transducer defines an acoustic propagation path for acoustic signals to or from the transducer, wherein the oil is contained in a housing, and the housing having an acoustically transparent surface with a known shape. More specifically includes a corrective lens for underwater transducers with protective oil dome to improve their performances at extreme condition and different types of oils.

2. History of Related Art

Various acoustic lenses are well known for use in medical ultrasonic probes in order to focus and control the beam angle and focal point mostly for high frequency. Different types of acoustic lenses for use in sonars are known, such as described in U.S. Pat. No. 3,990,035, U.S. Pat. No. 4,168,482 and U.S. Pat. No. 6,377,514. However, no satisfactory lenses have been proposed for use in sonar at extreme condition and lower frequencies.

Most of Offshore and Fisheries scanning sonar have a protective oil filled dome on the transducer. The transmitted wave from transducer goes through oil and passes the concave interface of oil-dome wall-water. The selected materials for dome and selected oil, normally has sound speed close to the water at room temperature and atmosphere pressure, therefore the ultrasonic beam does not deflect at interface of oil-water. But at higher-lower temperatures and pressures the sound speed changes differently for oil and water that cause the deflection of beam and consequently deteriorate the sonar performance.

SUMMARY OF THE INVENTION

Thus the object of the present invention is to provide a means for avoiding the deterioration of the sonar resulting from the temperature and depth variations. This is obtained using a sonar unit as stated above and being characterized as stated in the accompanying independent claim.

The present invention thus provides a solution where the sonar unit includes a comprising a corrective lens. As the corrective lens has a surface shape in the propagation path of the acoustic waves essentially corresponding to outer part of the lens in the acoustic propagation path the effects of the temperature or depth variations are reduced as the same changes will occur on both sides of the lens and dome.

BRIEF DESCRIPTION OF THE DRAWINGS

The invention will be described below with reference to the accompanying drawings, illustrating the invention by way of examples.

DETAILED DESCRIPTION OF ILLUSTRATIVE EMBODIMENTS OF THE INVENTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 1:
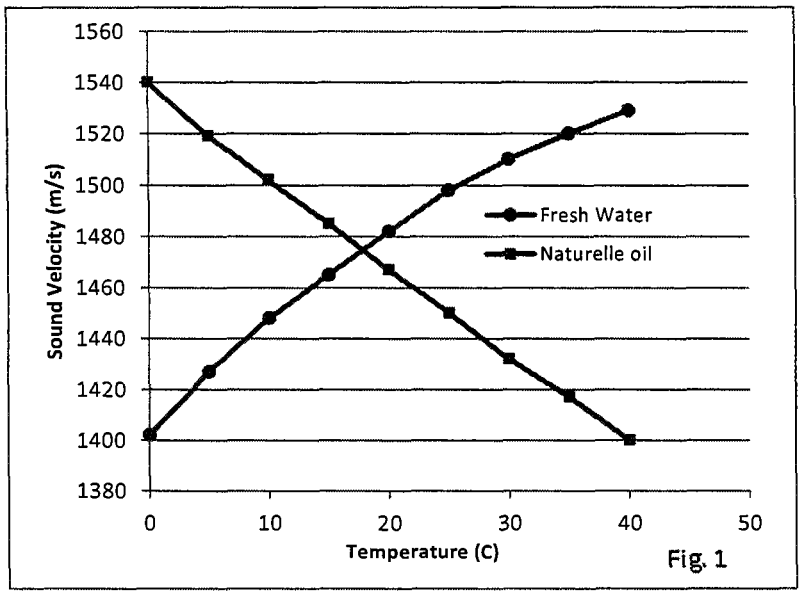
FIG. 1. shows variation of sound speed as a function of temperature for water and Naturelle oil.
Figure 2:
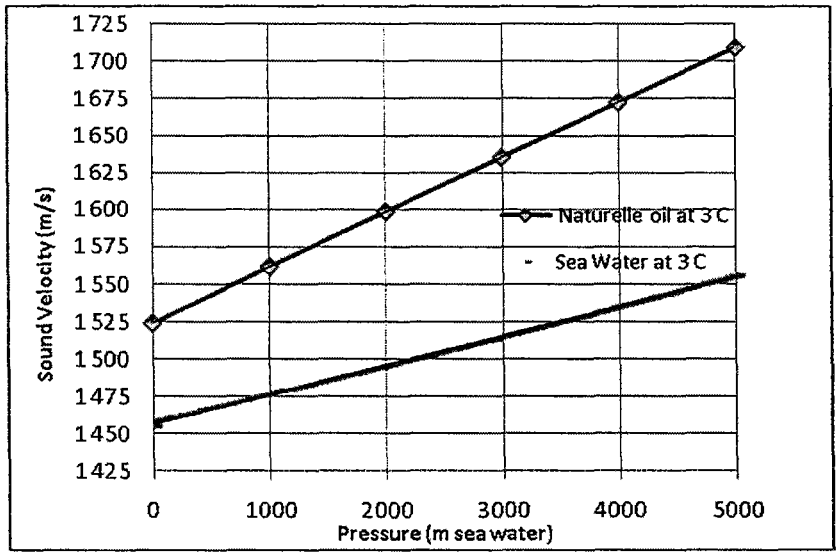
FIG. 2 shows variation of sound velocity versus pressure for Naturelle oil and sea water at 3° C.

FIG. 1 shows the variation of sound speed as a function of temperature for water and Naturelle oil. The impact of temperature on the speed of sound is exactly the opposite for oil and water. While at room temperature the sound speed of oil is close to water, at higher temperature such as 35° C. the differences is more than 100 m/s. FIG. 2 shows the sound speed increased more rapidly as a function of pressure in oil compare to the water at 3° C. At high depth such as 4000 m the sound speed difference reach 100 m/s. Consequently the difference in sound speed results beam de-focusing (widening) under pressure or in cold/warm waters. When a wave encounters different medium where the wave speed is different, the wave will change directions. Snell's law relates the directions of the wave before and after it crosses the boundary between the two media. Snell's law states that the ratio of the sine value of the angles of incidence and refraction is equivalent to the ratio of velocities in the two media. The deflection depends on sound speed difference and angle of incidence.

In order to solve this problem a lot of research was done to find a proper oil or liquids that could be used at different environmental condition. Unfortunately no oil could behave acoustically similar to water at different temperatures and pressures.

The idea of this invention is to put a "water filled lens" in front of the transducer element before putting the whole thing in the oil filled dome. This cancels the effect of sound speed variation.

Figure 3:
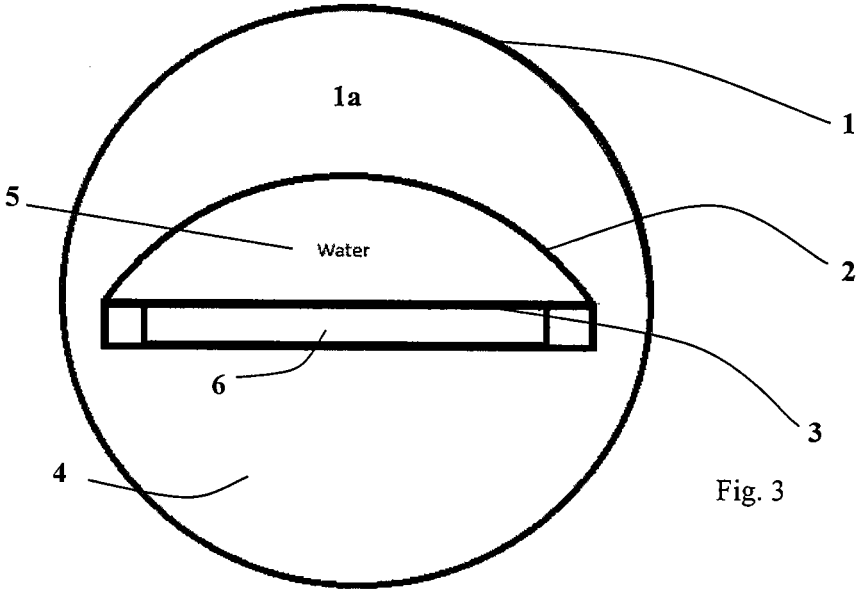
FIG. 3 is a cross sectional view of lens configuration inside dome. The acoustic lens 2 mounted on the transducer 3 filed with water that are installed inside the filled oil dome 1.

A cross section of lens configuration inside dome is shown in FIG. 3 showing an oil filled dome or housing 4 having a curved outer surface 1. A water filled corrective lens 5 is positioned inside the housing having an interface surface 2 against the oil filled housing and being coupled directly to the transducer 6 on the opposite side 3.

Figure 4:
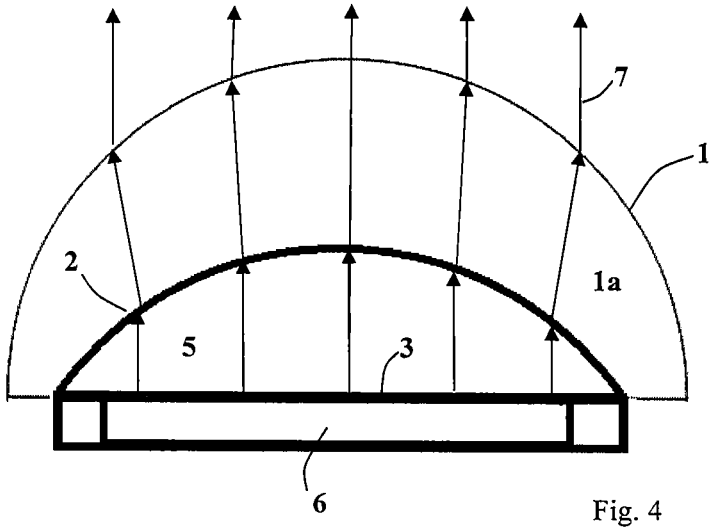
FIG. 4 shows the configuration of lens inside dome that ultrasonic beam is passing through two interfaces of water/oil and oil/water that the divergence in acoustic beam at first interface is modified by the second interface.

Referring to FIG. 4 this invention thus mainly concerns a corrective lens 5 for underwater transducers 6 enclosed in a protective oil dome 4 to improve their performances at extreme condition and different types of oil, where the oil dome 4 constitutes a housing where a part of the housing 1*a* constitutes a surface 1 between the surroundings, e.g. sea water, and the shape of the housing surface 1 has a curvature constituting a lens. The corrective lens 5 according to the invention is positioned between the housing part 1*a*, acting as a lens and the transducer 6 that has an interface surface 2 being in contact with the inner surface of the housing part. The corrective lens 5 is filled with water or similar liquid that has characteristics such as sound velocity being comparable to the surrounding sea water. The opposite side 3 of the corrective lens 5 is from the interface surface is stuck to the front of transducer element 6 so that the acoustic beam propagates from the transducer 6 through the corrective lens 5 and further through the housing 4 to the surroundings. The transducer element may be any available transducer being suitable for the application, and the part of the housing not constituting a lens may be made from different materials being transparent to the acoustic beam.

The corrective lens is preferably made from poly urethane (PU) with corresponding curvature and thickness of the dome of the housing part. The sound speed of PU family polymer is close to water at room temperature that makes it a good choice for dome and lens.

As can be seen from FIG. 4 the ultrasonic beam 7 passes through two interfaces 1,2 of water/oil first and then oil/water. Any convergence and divergence in acoustic beam at first interface may thus be cancelled or reduced at second interface, as it is shown in FIG. 4. Therefore the variation of sound speed at various environmental conditions could not deteriorate the sonar performance.

In order to cancel the effects of the sound variations, the shape of the interface surface has to be similar relative to the beam paths. Thus, as can be seen from the drawings, the beam at a certain distance from the central axis reaches the first interface at an angle and is then refracted accordingly. When reaching the second interface surface the angle at this point in the second interface surface is similar to the first interface point. Thus the direction of the beam is reestablished. In the illustrated example this results in a broader beam but having the same spread and direction as the original beam. The shape of the first interface surface thus has to be calculated so as to be essentially the same over the beam cross section, but related to a beam having a smaller cross section.

Figure 5:
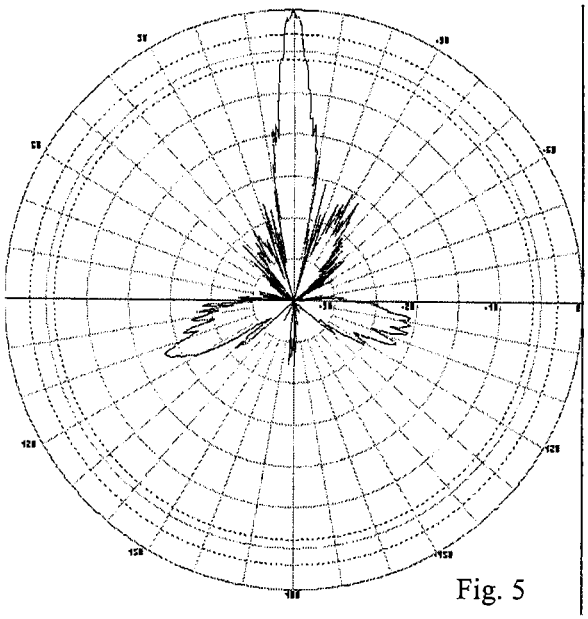
FIG. 5 shows the beam pattern for sonar at high temperature (equal to 40° C.) without lens.
Figure 6:
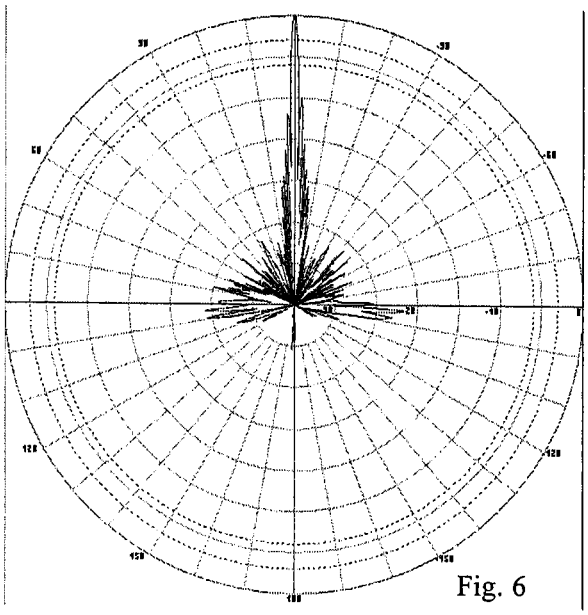
FIG. 6 shows the beam pattern for sonar at high temperature (equal to 40° C.) with lens.

FIGS. 5 and 6 shows the beam pattern for sonar at high temperature (equal to 40° C.) without and with lens. At this condition the speed of sound difference is about 150 m/s for oil and water. The lens brings back the beam pattern to the normal condition that could be obtained at room temperature (about 20° C.).

The acoustic lens according to the invention is thus preferably made from poly urethane or similar materials with sound speed close to water at room temperature.

The material is molded into a shape having one end face concavely shaped with similar curvature to dome curvature. The other its edges were glued to the transducer holder. The molded shape is preferably provided with a proper width according to the beam width of transducer that gives approximately equal incidence angles at front face of lens.

Thus to summarize the present invention relates to a subsea sonar unit comprising an acoustic transducer, defining an acoustic propagation path for acoustic signals to or from the transducer. In sonar applications the transducer may be a transmitter and/or a receiver. The unit also includes oil or any liquid filled housing at least a part of which being positioned in the propagation path of said beam, the housing having an acoustically transparent surface with a known shape in said propagation path. In the preferred embodiment the transducer itself is contained inside said housing being embedded into protective oil.

The unit also comprising a corrective lens, said corrective lens being mounted in said propagation path between said transducer. The corrective lens is placed between the transducer and the housing, the propagation path thus being defined from the transducer to a first surface defining an interface surface between the corrective lens and the housing. The shape of the first surface is chosen so as to correspond to the second surface on the opposite side of the housing part. The shape of the first surface and housing surface is thus chosen so as to affect the beam in opposite ways so as to cancel any variations in the sound speed which will lead to essentially similar shapes but at different scales.

Thus the interface defining the first surface between the corrective lens and the housing part has a shape relative to the cross section of said acoustic beam in the propagation path essentially corresponding to the shape of said housing surface relative to said beams cross section at said housing surface in said propagation path.

In the preferred embodiment of the invention the transducer is embedded in a protective oil, and the positioned a in a housing part of which the above-mentioned housing part constitutes a part.

The corrective lens is constituted by a water body enclosed in a polyurethane body of a chosen shape, or alternatively the water body may be exchanged with other materials, possibly molded, having sound speed close to water at room temperature. Preferably the material should be free of air bubbles that could not crash or deform at high pressure, and if liquid it may include an antifreezing agent could be added to the water in the case of application or storage of sonar at freezing temperature.

This corrective lens have a shape having one end face concavely shaped with similar curvature to housing part curvature, while the other edge of said lens is preferably glued to the transducer holder. The corrective lens may be given a shape with proper width according to the beam width of the transducer so as to give approximately equal incidence angles at front face of lens close to the transducer. The corrective lens should preferably be prepared, possibly filled with water and glued to the transducer before putting whole together with transducer into the oil filed dome.

What is claimed is:

1. A subsea sonar unit comprising:

an acoustic transducer, the acoustic transducer transmitting an acoustic beam defining an acoustic propagation path for acoustic signals to or from the acoustic transducer;

a housing comprising an oil filled part and positioned in the acoustic propagation path, the housing being acoustically transparent and having an outer surface with a known shape in said acoustic propagation path;

a corrective lens, said corrective lens being mounted in said acoustic propagation path between said transducer and said oil filled part, an interface between the corrective lens and the oil filled part defining a first surface having a shape relative to a cross section of said acoustic beam in the acoustic propagation path that essentially corresponds to the known shape of said outer surface relative to said acoustic beam's cross section at said outer surface in said acoustic propagation path; and wherein the oil filled part is positioned between said interface and said outer surface.

2. The unit according to claim 1, wherein the corrective lens comprises a water body enclosed in a polyurethane body of a chosen shape.

3. The unit according to claim 2, wherein said corrective lens comprises polyurethane with sound speed close to water at room temperature.

4. The unit according to claim 2, wherein a material of the corrective lens is molded into a shape having one end face concavely shaped with a similar curvature to a curvature of the housing.

5. The unit according to claim 4, wherein an edge of said corrective lens is glued to a holder of the acoustic transducer.

6. The unit according to claim 4, wherein said corrective lens is molded in shape with a proper width according to a beam width of the acoustic transducer that gives approximately equal incidence angles at a front face of the corrective lens.

7. The unit according to claim 2, wherein said corrective lens comprises materials that have sound speed close to water and is free of air bubbles that could crash or deform at high pressure.

8. The unit according to claim 2, wherein said corrective lens is filled with a water-based solution before being put together with the acoustic transducer into the oil filed part.

9. The unit according to claim 8, wherein said water-based solution comprises an antifreezing agent.

10. A subsea sonar unit comprising:

an acoustic transducer, the acoustic transducer transmitting an acoustic beam defining an acoustic propagation path for acoustic signals to or from the acoustic transducer;

a housing comprising an oil filled part and positioned in the acoustic propagation path, the housing being acoustically transparent and having an outer surface with a known shape in said acoustic propagation path;

a corrective lens, said corrective lens being mounted in said acoustic propagation path between said transducer and said oil filled part, an interface between the corrective lens and the oil filled part defining a first surface having a shape relative to a cross section of said acoustic beam in the acoustic propagation path that essentially corresponds to the known shape of said outer surface relative to said acoustic beam's cross section at said outer surface in said acoustic propagation path;

wherein the corrective lens comprises a water body enclosed in a polyurethane body of a chosen shape; and wherein a material of the corrective lens is molded into a shape having one end face concavely shaped with a similar curvature to a curvature of the housing.

11. The unit according to claim 10, wherein an edge of said corrective lens is glued to a holder of the acoustic transducer.

12. The unit according to claim 10, wherein said corrective lens is molded in shape with a proper width according to a beam width of the acoustic transducer that gives approximately equal incidence angles at a front face of the corrective lens.

* * * * *